US009259826B2

(12) United States Patent
Söderlund

(10) Patent No.: US 9,259,826 B2
(45) Date of Patent: Feb. 16, 2016

(54) POWER WRENCH WITH HYDRAULIC PULSE UNIT

(75) Inventor: Per Thomas Söderlund, Värmdö (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 583 days.

(21) Appl. No.: 13/697,107

(22) PCT Filed: Mar. 18, 2011

(86) PCT No.: PCT/EP2011/054094

§ 371 (c)(1),
(2), (4) Date: Nov. 9, 2012

(87) PCT Pub. No.: WO2011/141205

PCT Pub. Date: Nov. 17, 2011

(65) Prior Publication Data

US 2013/0056237 A1 Mar. 7, 2013

(30) Foreign Application Priority Data

May 12, 2010 (SE) ..... 1000490

(51) Int. Cl.
*B25B 21/02* (2006.01)

(52) U.S. Cl.
CPC ..... *B25B 21/02* (2013.01)

(58) Field of Classification Search
CPC ..... B25B 21/02; B25B 21/005; B25D 9/145; B25D 11/125
USPC ..... 173/200, 201, 218; 464/25; 81/57.44; 55/403, 421
See application file for complete search history.

(56) References Cited

U.S. PATENT DOCUMENTS 6,110,045 A 8/2000 Schoeps
2009/0008117 A1 1/2009 Kettner

FOREIGN PATENT DOCUMENTS

EP 0885693 A2 12/1998
EP 1920888 A1 5/2008

OTHER PUBLICATIONS

International Search Report dated Aug. 25, 2011 issued in International Appln. No. PCT/EP2011/054094.

*Primary Examiner* — Robert Long
*Assistant Examiner* — Xavier A Madison
(74) *Attorney, Agent, or Firm* — Holtz, Holtz & Volek PC

(57) ABSTRACT

A power wrench has a rotation motor, and a hydraulic pulse unit. The pulse unit includes an inertia drive unit connected to the motor. The inertia drive unit includes an oil chamber with an impulse generating mechanism, and an output spindle extending into the oil chamber to receive torque impulses. The inertia drive unit has a cylindrical member defining the oil chamber, a rear end wall, and an air separator element co-rotating with the wall and having a substantially axially facing surface which together with a congruent surface on the rear end wall forms oil passages in the form of a clearance gap through which oil mixed with air is circulated between one or more oil inlet openings, past one or more air outlet openings, to one or more oil outlet openings. Air is extracted from the oil and is gathered in a centrally located air collecting chamber.

12 Claims, 4 Drawing Sheets

POWER WRENCH WITH HYDRAULIC PULSE UNIT

This application is a U.S. National Phase Application under 35 USC 371 of International Application PCT/EP2011/054094 filed Mar. 18, 2011.

BACKGROUND OF THE INVENTION

1. Field of the Invention

The invention relates an impulse type power wrench including a rotation motor, and a hydraulic pulse unit intermittently coupling the motor to an output shaft for delivering repeated torque impulses to a screw joint to be tightened.

In some power wrenches of this type there is a problem to fill the pulse unit with an exactly correct amount of oil such that there will be enough air left inside the pulse unit to absorb some heat related expansion of the oil during operation of the wrench. The main reason, though, why a certain amount of air is left in the oil volume is to make the oil volume somewhat elastically compressible to thereby enhance the impulse frequency of the pulse unit. A too small percentage of air in the oil will cause a great pressure inside the pulse unit resulting in friction losses and overheating, whereas a too large percentage of air will reduce the efficiency of the pulse unit.

2. Description of the Related Art

In some other pulse units the oil filling problem is solved by using an elastic element or accumulator to compensate for heat related expansions and to obtain a certain elasticity of the oil volume, which means that in those cases the pulse units can be filled up completely without leaving any air in the oil volume. An impulse generator having this feature is described in U.S. Pat. No. 6,110,045.

However, there is still a problem in that there will inevitably be a certain oil leakage, although initially small, from the pulse unit during operation of the wrench, which means that air will penetrate into the pulse unit in a corresponding amount. The result is that that there will be an increased amount of air inside the pulse unit over time. Accordingly, the percentage of air in the oil volume will increase successively, and after some service time of the wrench the increased amount of air in the pulse unit will cause an impaired efficiency and finally a complete loss of impulse generation, so called spinning.

Theoretically, it would be possible to extend the service intervals of the power wrench by substantially increasing the size of the entire oil containing volume of the pulse unit to thereby keep down the percentage of air in the oil volume caused by leakage. The result would be that the elasticity of the oil volume would be kept low during an extended power wrench operation time and that the pulse generation efficiency would be maintained at a high level for prolonged service intervals. After some time of operation, though, there will still be an undesirably high percentage of air, even in such an enlarged oil chamber. The obvious drawback of such an enlarged oil volume would be increased outer dimensions and weight of the pulse unit and, hence, the entire power wrench. That would not be acceptable.

SUMMARY OF THE PRESENT INVENTION

It is an object of the invention to provide an improved power wrench including a hydraulic pulse unit with a separator for extracting air from oil to thereby keep up the pulse efficiency for substantially extended service intervals of the power wrench at maintained small dimensions of the pulse unit.

A further object of the invention is to provide a power wrench including a hydraulic pulse unit with a separator for extracting air from oil by centrifugal action, and a separate air collecting chamber for gathering separated air.

Still further objects of the invention will appear from the following specification and claims.

A preferred embodiment of the invention is described below with reference to the accompanying drawings.

DETAILED DESCRIPTION OF THE PREFERRED EMBODIMENT

Figure 1:
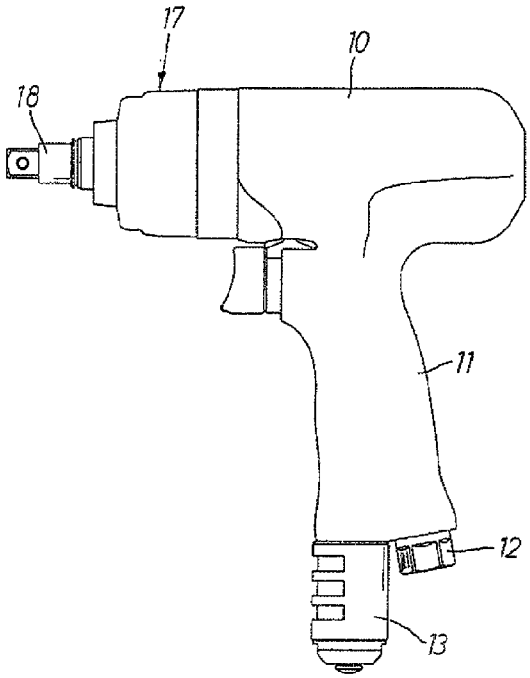
FIG. 1 shows a side view of a power wrench according to the invention.

The power wrench shown as an example in the drawings is a pneumatically powered pistol type wrench which comprises a housing 10 with a handle 11. The latter carries at its lower end a connection piece 12 for a pressure air conduit and an exhaust air silencer 13. A throttle valve for power control is maneuvered by a trigger button. In the housing there is provided a non-illustrated motor, and a hydraulic pulse unit 17 with a square ended output shaft 18.

Figure 2:
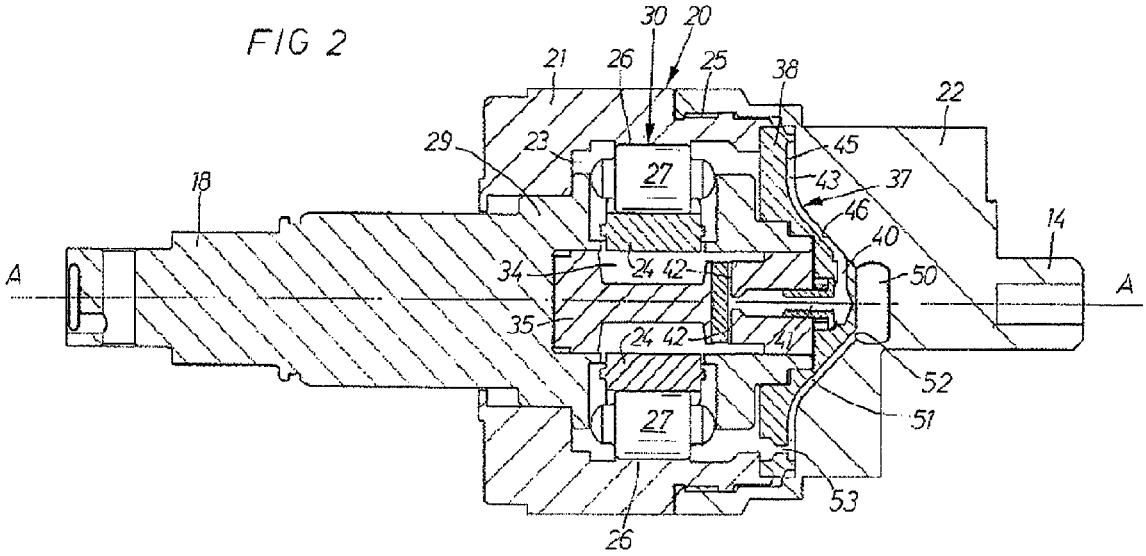
FIG. 2 shows a longitudinal section through the pulse unit of the power wrench in FIG. 1.
Figure 3:
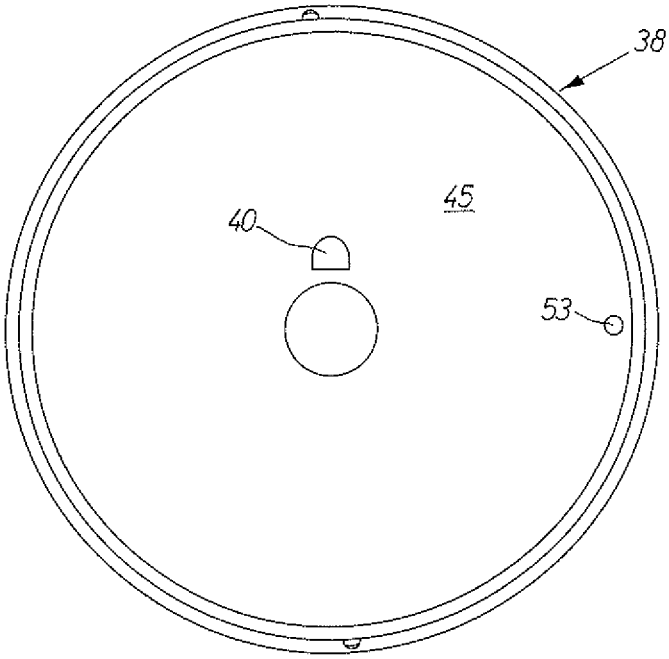
FIG. 3 shows a rear end view of the separator member in FIG. 2 illustrating one embodiment of the oil-air separator.

As illustrated in FIG. 2, the impulse unit comprises an inertia drive member 20 including a cylindrical element 21 with a rear end wall 22 and enclosing an oil chamber 23. The rear end wall 22 is formed with a coupling portion 14 for permanent connection to the motor and is secured to the cylindrical element 21 by a thread connection 25.

The output shaft 18 has an impulse receiving portion 29 which extends into the oil chamber 23 and is intermittently coupled to the drive member 20 via an impulse generating mechanism 30. The latter comprises a couple of piston elements 24 and rolling elements 27 rotatively locked to the output shaft and acted upon sequentially in radially inward directions by cam profiles 26 on the cylindrical element 21 so as to compress oil between them in a central high pressure chamber 34, thereby generating torque impulses. A cam spindle 35 is secured to the rear end wall 22 and extends coaxially into the high pressure chamber 34 and is effective in returning the piston elements 24 outwardly after each impulse generation.

The operation of the impulse mechanism per se is not described in any further detail since it is previously described in U.S. Pat. No. 6,110,045.

The rear end wall 22 also comprises an air separator 37 including a substantially axially facing surface 46, and a separator element 38 which is rigidly clamped between the end wall 22 and the cylindrical element 21. The separator element 38 has a substantially axially facing surface 45 located opposite and being congruent with the surface 46 on the end wall 22. Both surfaces 45,46 have a slightly conical shape, and the separator element 38 has a central oil inlet opening 40 which communicates with the high pressure chamber 34 via a central passage 41 and two radial openings 42 located in the cam spindle 35. The openings 42 have very small flow areas and are adapted to prevent high pressure peaks from reaching the separator 37 but to let through a tiny oil flow only. Adjacent the periphery the separator element 38 is provided with an oil outlet opening 53, and close to the rotation axis A-A there is provided an air outlet opening 52. The surfaces 45,46 form between them a clearance gap 43 which serves as an oil circulation passage, and oil entering the clearance gap 43 via the inlet opening 40 will be forced outwardly by centrifugal action towards the oil outlet opening 53.

Figure 4:
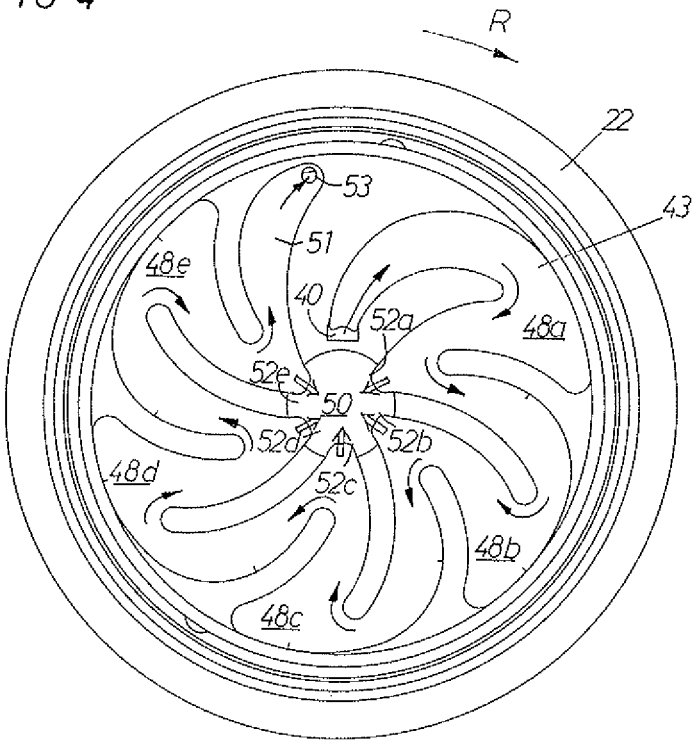
FIG. 4 shows an alternative embodiment of the oil-air separator.

In the embodiment illustrated in FIG. 4 the clearance gap 43 comprise a series of substantially loop-shaped grooves 48*a-e* formed in the separator element 38, wherein a groove 48*a* communicates with the oil inlet opening 40. At their central parts all of the grooves 48*a-e* communicate with an air collecting chamber 50 located in the rear end wall 22 at the rotation axis A-A. The loop-shaped grooves 48*a-e* are series connected to each other, wherein the downstream groove portion 48*e* communicate with an oil outlet opening 53 via a substantially radial oil discharge passages 51. The oil outlet opening 53 is disposed at a radial distance from the rotation axis A-A and communicates with the oil chamber 23.

The grooves 48*a-e* on the surface 45 of the separator element 38 forming the clearance gap 43 are produced in any suitable way, for instance at a sintering process forming the entire separator element 38.

During operation of the impulse unit the inertia drive member 20 is rotated by the motor and when a torque load is applied on the output shaft 18 a relative rotation between the inertia drive member 20 and the output shaft 18 will take place and rolling elements 27 and the piston elements 24 will be urged inwardly by the cam profiles 26 to create a high pressure in the high pressure chamber 34. Thereby, a torque impulse is accomplished in the output shaft 18. Due to an inevitable leakage there will always be some amount of air mixed into the oil volume, and if that amount becomes too large the efficiency of the impulse unit will decline. The separator 37 will see to that the amount of air is kept low as long as possible to keep up the efficiency of the impulse unit.

At impulse generation the high pressure peaks in the chamber 34 will cause a small intermittent flow of oil to be extruded through the openings 42, and the passage 41, and reach the oil inlet opening 40 of the separator 37. Since the separator 37 is co-rotating with the inertia drive member 20 there will be a centrifugal action influencing on the oil in the clearance gap 43. The oil will be forced outwardly through the first loop-shaped grove 48*a*, which means that the oil flow also is turned inwardly for a certain distance before entering the next loop-shaped groove 48*b*. See the filled arrows illustrating the oil flow and the open arrows illustrating the air escape flow to the air collecting chamber 50 via air outlet openings 52*a-e*.

Depending on the substantial difference in density between oil and air the centrifugal action will force the oil radially outwardly and the air inwardly, which means that the air will be pressed into the central air collecting chamber 50 via the air outlet openings 52*a-e*, whereas the oil flow continues through the next loop-shaped groove 48*b* and further on through the following grooves 48*c*, 48*d* and 48*e*. Remaining air in the oil flow will be pressed out of the oil flow from all loop-shaped grooves 48*a-e* through the outlet openings 52*a-e* and into the air collecting chamber 50 such that when the oil leaves the separator 37 via the discharge passage 51 and the outlet opening 53 all air mixed into the oil is separated and gathered in the collection chamber 50. By the repeated centrifugal separations in the loops 48*a-e* all air mixed into the oil will be extracted, and a substantially air free oil is discharged back into the oil chamber 23.

In order to enhance the separating effect the loop-shaped grooves 48*a-e* are asymmetric to take advance of the retardation forces during impulse generation in the rotation direction R of the inertia drive member 21. The inertia of the oil urges the oil even stronger radially outwardly while the air is pressed inwardly to reach the air outlet openings 52*a-e*.

Since the entire pulse unit 17 is filled up with oil from the beginning also the air collecting chamber is filled up with oil. After some time of operation there will be gathered air in the collection chamber 50, but due to the very fine dimensions of the loop-shaped grooves 48*a-e* oil rather than air will be retracted by capillary action from the collection chamber 50 to return into the oil chamber 23. This means that air is gathered in the collection chamber 50, whereas oil is leaving it. Alternatively, wicks of a felt material could be arranged to suck via capillary action oil from the collection chamber 50

Figure 5:
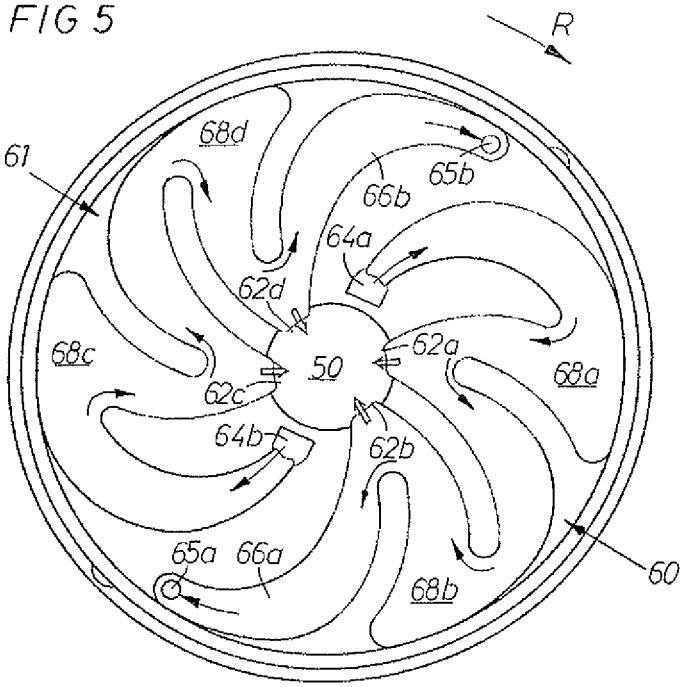
FIG. 5 shows still another embodiment of the oil-air separator.

In the embodiment of the air separator illustrated in FIG. 5 the oil circulating loop-shaped grooves 68*a-d* on the separator element 38 are four in number and divided into two sections 60 and 61, whereof one section 60 comprises two loop-shaped grooves 68*a,b* and the other section 61 two loop-shaped grooves 68*c,d*. Each section has an oil inlet opening 64*a,b* located close to the rotation axis A-A of the inertia drive member 20 and an oil discharge passage 66*a,b* with an oil outlet opening 65*a,b* at a radial distance from the rotation axis A-A. As in the previously described embodiment each groove 68*a-d* has a central air outlet opening 62*a-d* opening into the air collection chamber 50.

During operation an oil flow is extruded from the high pressure chamber 34 into the separator 37 via the openings 41 and 42 in the valve spindle 35 and the inlet openings 64. The oil containing a certain amount of mixed in air is circulated through the loop-shaped grooves 68*a-d*, wherein air is pressed out through the outlet openings 62*a-d* and oil is leaving the separator 37 through the outlet openings 65*a,b*.

Figure 6:
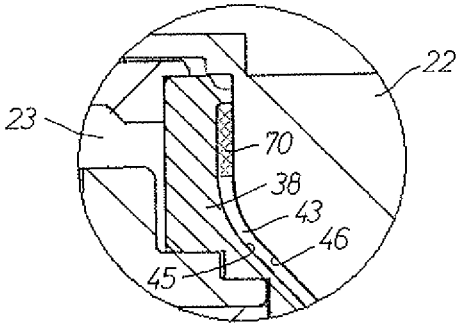
FIG. 6 shows, on a larger scale, a sectional view of a part of the oil-air separator with an oil filter.

In FIG. 6 there is illustrated an annular filter element 70 inserted in the clearance gap 43 between the surfaces 45, 46 for separating also metallic or other undesirable particles from the oil, thereby avoiding inter alia unnecessary mechanical wear of the impulse unit parts.

Figure 7:
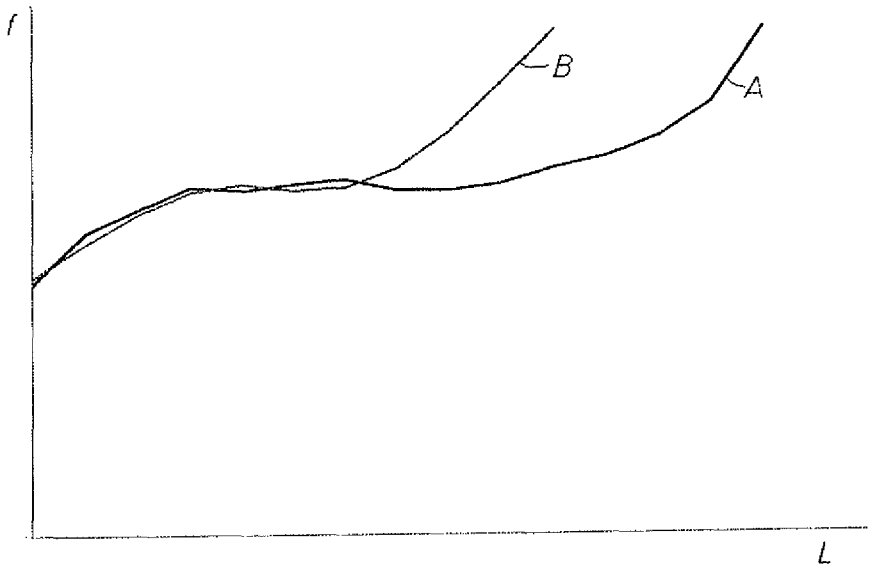
FIG. 7 shows a diagram illustrating the impulse frequency of the pulse unit in relation to the amount of oil leakage.

By the diagram shown in FIG. 7 there is illustrated by curve A how the pulse frequency f is kept at a lower level at an increasing amount of oil leakage L when using the air separator according to the invention compared to a faster increasing pulse frequency f at increasing amount of oil leakage L at prior art pulse units according to curve B.

Figure 8:
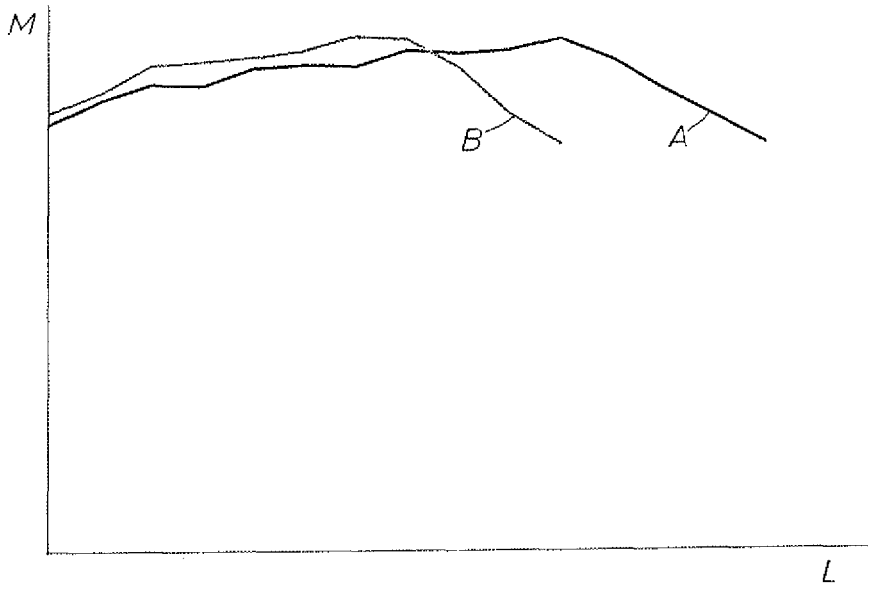
FIG. 8 shows a diagram illustrating the torque output of the pulse unit in relation to the amount of oil leakage.

By the diagram shown in FIG. 8 there is illustrated by the curve A how the torque output M of a pulse unit using an air separator according to the invention is maintained at a high level at an increasing amount of oil leakage L compared to a faster decreasing output torque M at increasing amount of oil leakage L at prior art pulse units according to curve B.

As illustrated by the diagrams in FIGS. 7 and 8 the employment of an air separator according to invention means an extended high performance of a pulse generator and extended service intervals of the impulse tool. This means an improved accessibility of the impulse tool as well as an economical advantage for the operator.

The invention claimed is:

1. A power wrench comprising:

an output shaft; and a hydraulic pulse unit including an inertia drive member drivable by a motor and rotatable about a rotation axis, an oil chamber enclosed in the inertia drive member, and an impulse generating mechanism comprising a high pressure chamber and arranged to intermittently transfer kinetic energy to the output shaft, the inertia drive member comprising a cylindrical part and a transverse end wall, wherein a separator is provided for extracting air from oil by centrifugal action, wherein the separator comprises:

a substantially axially facing surface on the transverse end wall;

a disc shaped separator element co-rotating with the transverse end wall, the disc shaped separator element being formed with a substantially axially facing surface, and the substantially axially facing surface of the disc shaped separator element being congruent with the substantially axially facing surface on the transverse end wall;

a clearance gap formed between the substantially axially facing surface of the disc shaped separator element and the substantially axially facing surface on the transverse end wall;

an oil inlet opening in the separator element located adjacent to the rotation axis;

a flow restricted oil inlet passage connecting the clearance gap with the high pressure chamber;

at least one oil outlet opening located at a radial distance from the rotation axis and arranged to drain oil from the clearance gap to the oil chamber;

an air collecting chamber located at the rotation axis, and at least one air outlet opening located adjacent to the rotation axis and connecting the clearance gap with the air collecting chamber.

2. The power wrench according to claim 1, wherein the air collecting chamber is formed by a cavity in the end wall.

3. The power wrench according to claim 1, wherein the clearance gap extends over an entire extent of the the substantially axially facing surface of the disc shaped separator element and the substantially axially facing surface on the transverse end wall.

4. The power wrench according to claim 2, wherein the clearance gap extends over an entire extent of the the substantially axially facing surface of the disc shaped separator element and the substantially axially facing surface on the transverse end wall.

5. The power wrench according to claim 1, wherein an oil filter element is provided in the clearance gap.

6. The power wrench according to claim 2, wherein an oil filter element is provided in the clearance gap.

7. The power wrench according to claim 3, wherein an oil filter element is provided in the clearance gap.

8. The power wrench according to claim 4, wherein an oil filter element is provided in the clearance gap.

9. The power wrench according to claim 1, wherein the clearance gap comprises one or more substantially loop-shaped grooves formed on one of the separator element and the end wall, the substantially loop-shaped grooves connecting the oil inlet opening with the at least one oil outlet opening and the at least one air outlet opening.

10. The power wrench according to claim 2, wherein the clearance gap comprises one or more substantially loop-shaped grooves formed on one of the separator element and the end wall, the substantially loop-shaped grooves connecting the oil inlet opening with the at least one oil outlet opening and the at least one air outlet opening.

11. The power wrench according to claim 9, wherein the substantially loop-shaped grooves are divided into at least two sections, each comprising an oil inlet opening, a oil outlet opening, and at least one air outlet opening.

12. The power wrench according to claim 10, wherein the substantially loop-shaped grooves are divided into at least two sections, each comprising an oil inlet opening, a oil outlet opening, and at least one air outlet opening.

* * * * *